US009449727B2

(12) United States Patent
Zacharopoulos et al.

(10) Patent No.: US 9,449,727 B2
(45) Date of Patent: Sep. 20, 2016

(54) INTERLOCKED COLLIMATORS FOR A MEDICAL LINEAR ACCELERATOR

(71) Applicant: AKTINA CORP., Congers, NY (US)

(72) Inventors: Nicholas G. Zacharopoulos, Congers, NY (US); Milan Markovic, Wayne, NJ (US)

(73) Assignee: AKTINA CORP., Congers, NY (US)

( * ) Notice: Subject to any disclaimer, the term of this patent is extended or adjusted under 35 U.S.C. 154(b) by 306 days.

(21) Appl. No.: 14/143,788

(22) Filed: Dec. 30, 2013

(65) Prior Publication Data

US 2014/0183343 A1 Jul. 3, 2014

Related U.S. Application Data

(60) Provisional application No. 61/747,972, filed on Dec. 31, 2012.

(51) Int. Cl.
*G21K 1/02* (2006.01)
*H05H 7/00* (2006.01)

(52) U.S. Cl.
CPC . *G21K 1/02* (2013.01); *H05H 7/00* (2013.01)

(58) Field of Classification Search
CPC ..... G21K 1/02
USPC ..... 250/216
See application file for complete search history.

(56) References Cited

U.S. PATENT DOCUMENTS 4,221,971 A * 9/1980 Burger ..... G21K 1/04 378/145
2009/0187174 A1* 7/2009 Rathjen ..... G02B 21/248 606/5

* cited by examiner

*Primary Examiner* — Renee Chavez
(74) *Attorney, Agent, or Firm* — Donald J. Ranft; Collen IP

(57) ABSTRACT

An apparatus for detecting small field circular collimators when connected to a linear accelerator machine (LINAC). Each small field circular collimator is provided with some uniquely identifying trait depending upon its size. The adaptor of LINAC includes sensors to detect the uniquely identifying trait of the small field circular collimator. The information from the sensor about the small field circular collimator is conveyed to the LINAC to verify that the collimator is properly installed and the correct size collimator is being used.

18 Claims, 6 Drawing Sheets

INTERLOCKED COLLIMATORS FOR A MEDICAL LINEAR ACCELERATOR

CROSS-REFERENCE TO RELATED APPLICATION

This non-provisional application claims priority from provisional Application No. 61/747,972 filed in the United States Patent and Trademark Office on Dec. 31, 2012.

FIELD OF THE INVENTION

The present invention relates to medical linear accelerator machines (LINAC) and collimators.

BACKGROUND OF THE INVENTION

A traditional LINAC has a mount plate with an adaptor which accepts different accessories. Almost all of these accessories are "interlocked" with coding so that the installation of the wrong accessory does not allow for radiation to be delivered to the patient. The unique code for each accessory is specified during the computer assisted creation of the patient's treatment plan.

However, problems can arise with the use of certain accessories, particularly small field circular collimators, which are typically used to treat small brain lesions. Small field circular collimators are not interlocked with coding and therefore their use may result in human error, which can lead to serious clinical mistakes. For example, the small field circular collimator may be improperly used or left off entirely, but there is no mechanism to alert the operator and/or prevent the LINAC machine from operating. The present invention solves this problem by disclosing a set of small field circular collimators which are capable of being individual identified by sensors incorporated in the adaptor of the LINAC.

SUMMARY OF THE INVENTION

The present invention is a detection system including a set of small field circular collimators which are capable of being individually identified by sensors in the adaptor of the LINAC.

DETAILED DESCRIPTION

The present invention is a detection system with a set of small field circular collimators 1 which are capable of being individually identified by sensors included in the adaptor 2 of a typical medical linear accelerator machine (LINAC). The information from the sensors regarding the identity of the particular collimator 1 is conveyed to the LINAC to verify that the LINAC may be started and the treatment properly administered.

Figure 1:
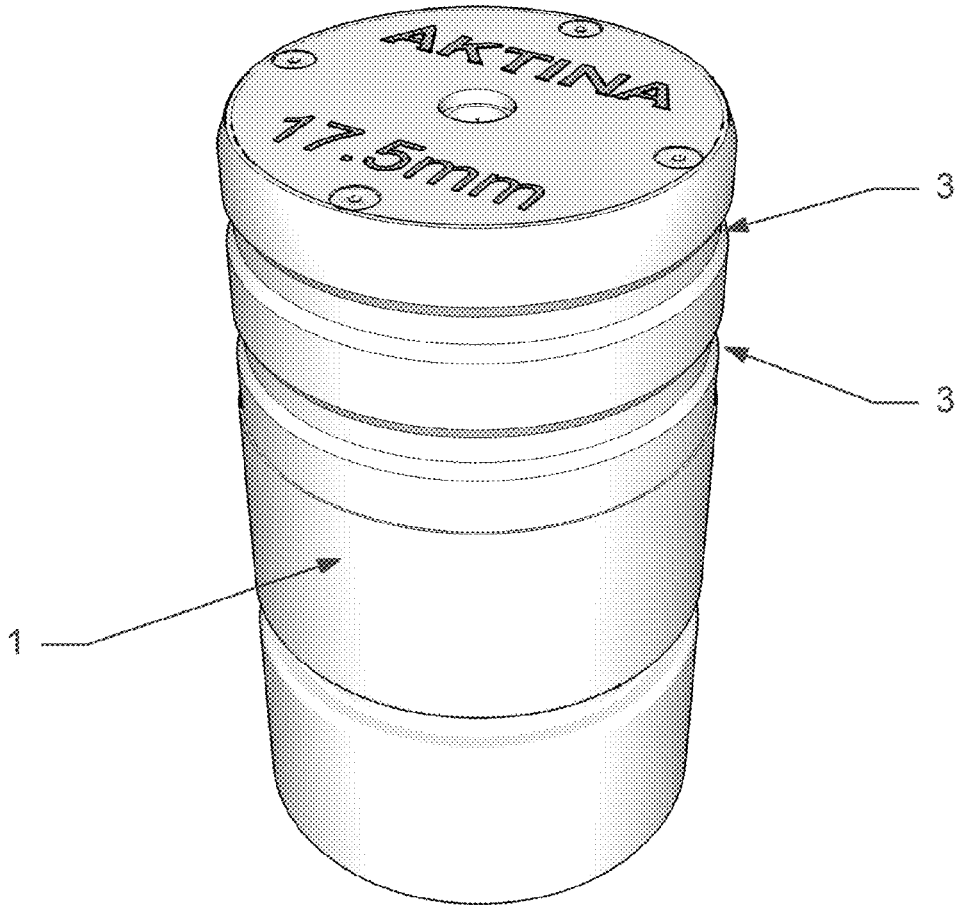
FIG. 1 is a top perspective view of a collimator.
Figure 2:
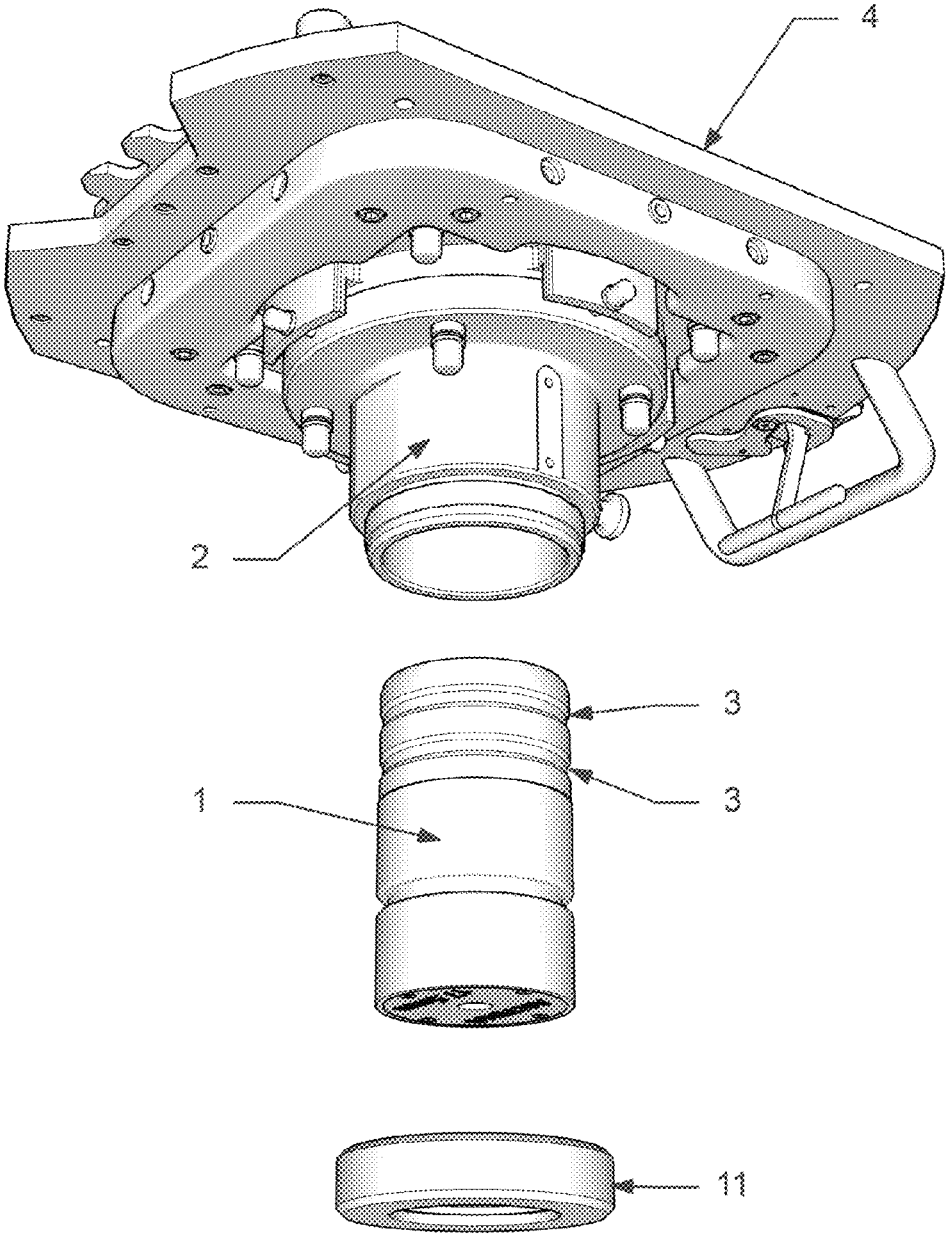
FIG. 2 is a bottom perspective view of a mount plate, adaptor, collimator, and cap assembly.
Figure 3:
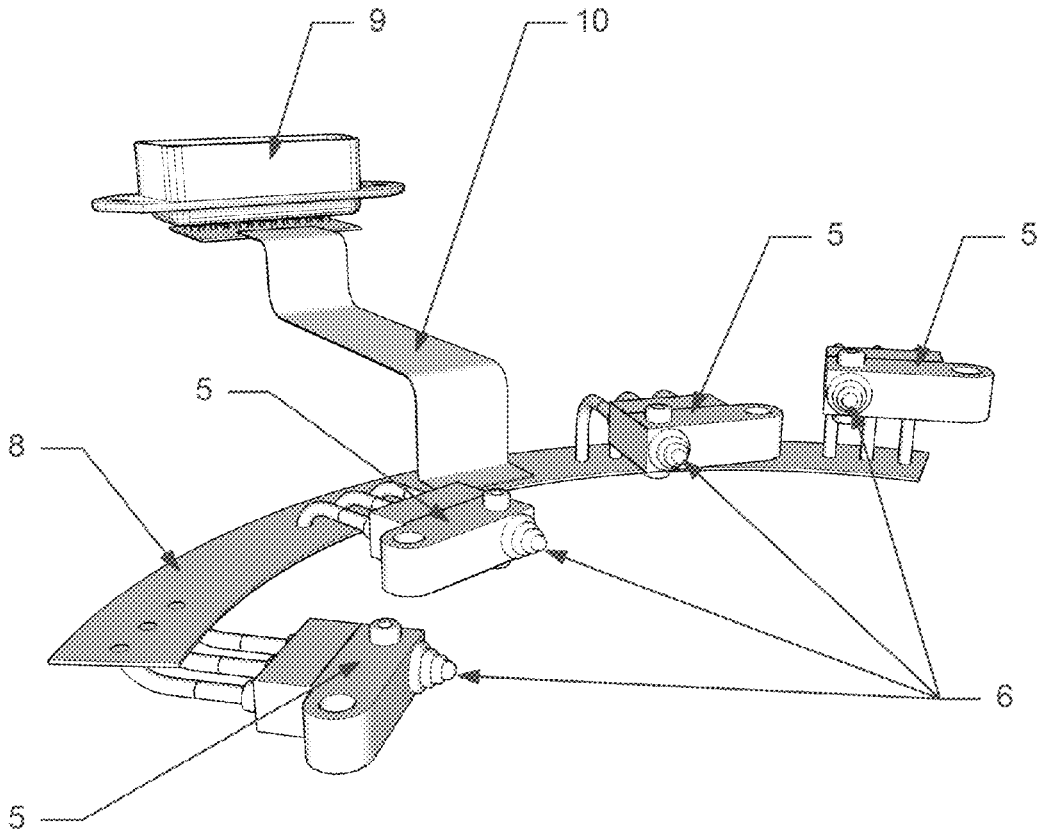
FIG. 3 is a perspective view of the micro-switches, circuit board, ribbon cable, and LINAC connector.
Figure 4:
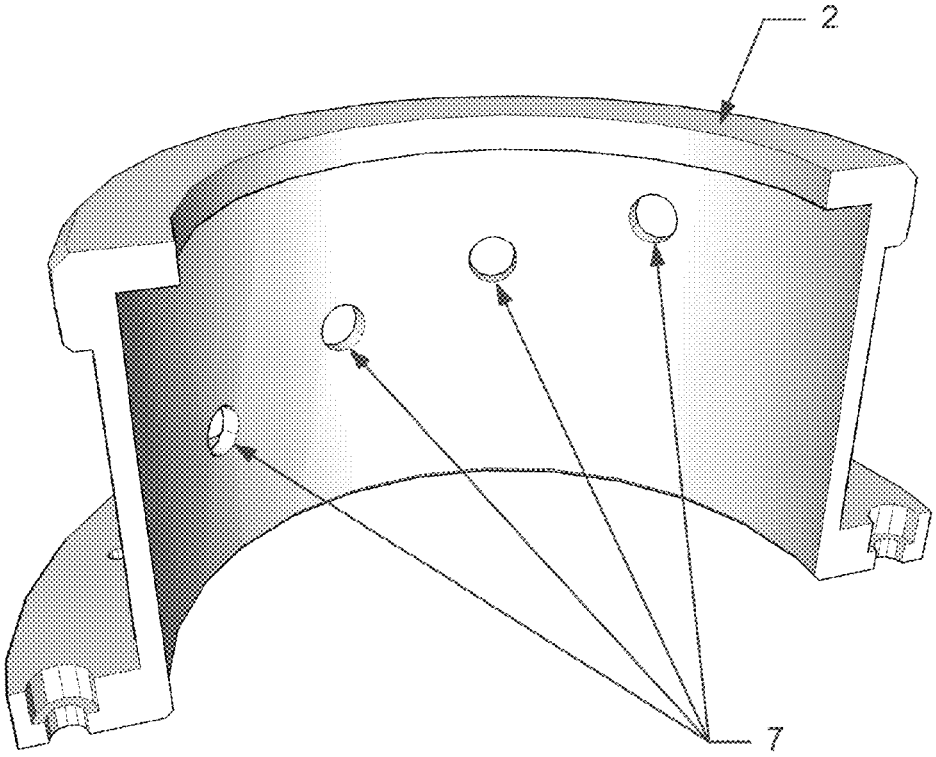
FIG. 4 is a cross-sectional view of an adaptor.
Figure 5:
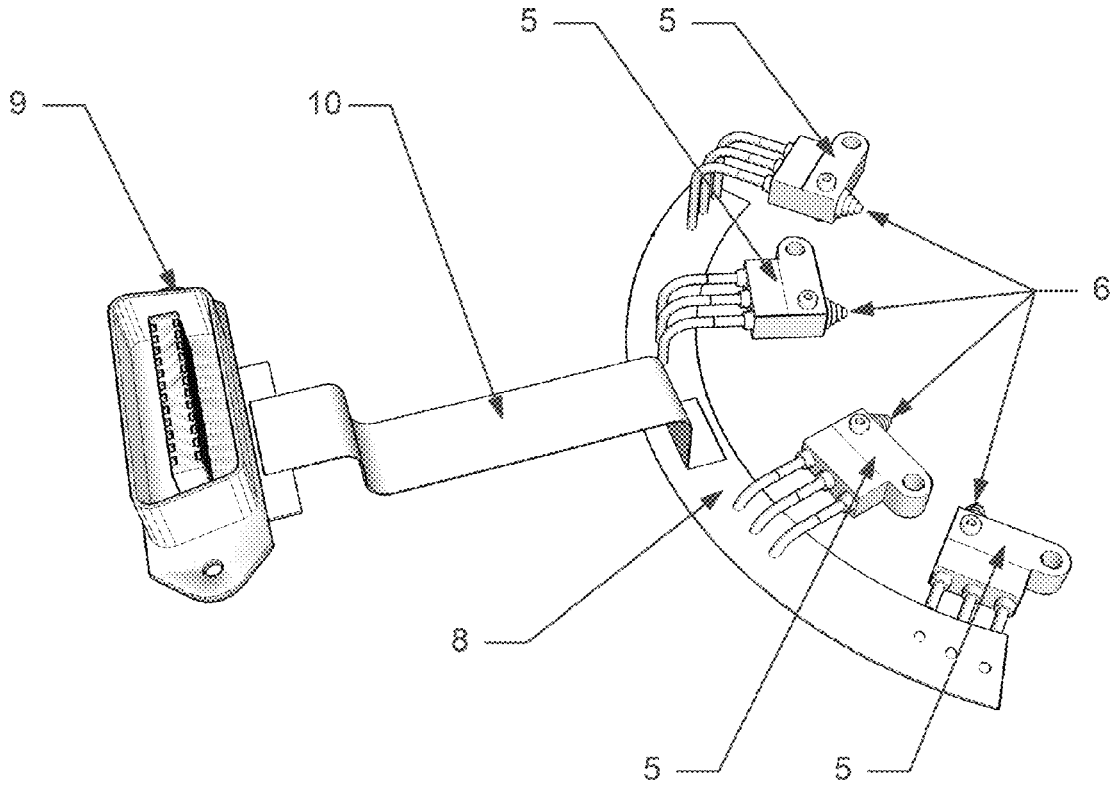
FIG. 5 is a top perspective view of the micro-switches, circuit board, ribbon cable, and LINAC connector.
Figure 6:
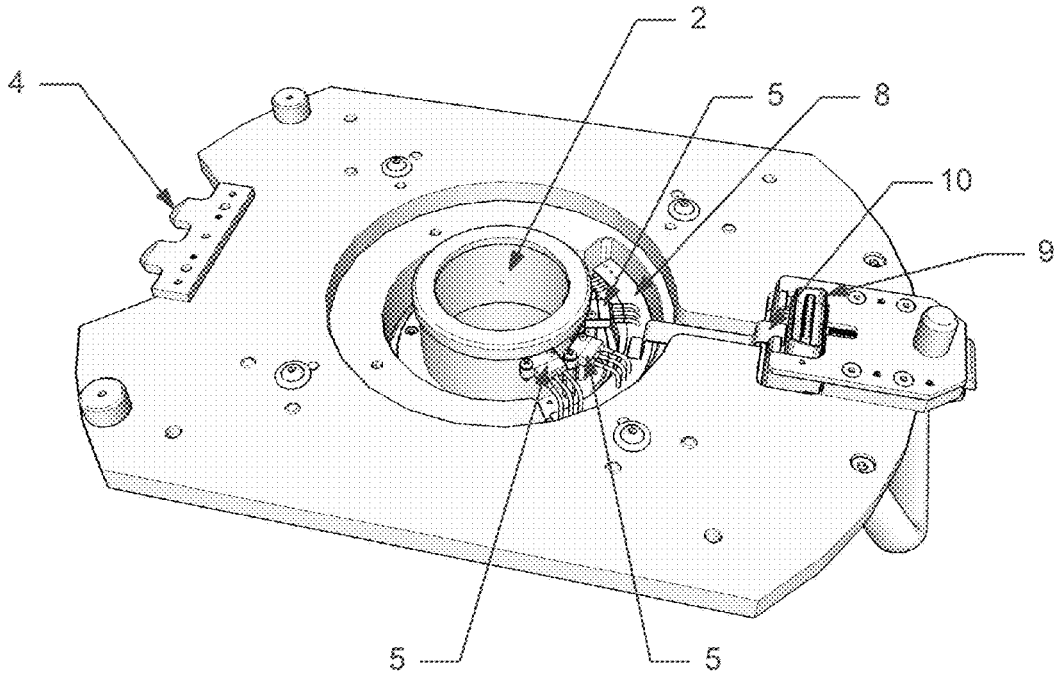
FIG. 6 is a top perspective view of a mount plate, adaptor, micro-switches, circuit board, ribbon cable, and LINAC connector.

As shown in FIG. 1, in one embodiment, the small field circular collimators 1 have unique traits generated by identification grooves 3 in the perimeter thereof which correspond to the size of the particular collimator 1. As is typical, the adaptor 2 is attached to a mount plate 4 which is attached to the linear accelerator machine (LINAC). In this embodiment, the sensors are micro-switches 5, the activation levers 6 of which are situated within through-holes 7 of the adaptor 2. The through-holes 7 (and the activation levers 6 which they house) are positioned at different heights along the adaptor 2 corresponding to the different heights of the identification grooves 3 of the collimators 1. The micro-switches 5 transmit their position to the LINAC. One way to accomplish this is to connect each micro-switch 5 to a circuit board 8, which is connected to a LINAC connector 9 by a ribbon cable 10.

When the top end of a particular small field circular collimator (cone) 1 is inserted into the adaptor 2, each of the activation levers 6 is either activated or not activated depending on the location of the particular collimator's 1 identification grooves 3. For example, if an identification groove 3 is aligned with an activation lever 6, the activation lever 6 is not activated. If there is no identification groove 3 aligned with an activation lever 6, the activation lever 6 is activated. In this way, a binary number is generated depending on whether an activation lever 6 is activated or not (i.e. 0=not pressed/not activated, 1=pressed/activated). Depending on which of the activation levers is activated and the associated binary code, a decimal number corresponding to a particular cone size is generated. The decimal number generated may be designed to correspond to the mm size of the small field circular collimator.

| Switch Number | | | | | | Dec | Cone size |
|---|---|---|---|---|---|---|---|
| 6 | 5 | 4 | 3 | 2 | 1 | number | [mm] |
| 0 | 0 | 0 | 1 | 0 | 0 | 4 | 4 |
| 0 | 0 | 0 | 1 | 0 | 1 | 5 | 5 |
| 0 | 0 | 0 | 1 | 1 | 0 | 6 | 6 |
| 0 | 0 | 0 | 1 | 1 | 1 | 7 | 7 |
| 0 | 0 | 1 | 0 | 0 | 0 | 8 | 8 |
| 0 | 0 | 1 | 0 | 0 | 1 | 9 | 9 |
| 0 | 0 | 1 | 0 | 1 | 0 | 10 | 10 |
| 0 | 0 | 1 | 0 | 1 | 1 | 11 | 11 |
| | | | | ... | | | |
| 1 | 0 | 0 | 1 | 0 | 0 | 36 | 36 |
| 1 | 0 | 0 | 1 | 0 | 1 | 37 | 37 |
| 1 | 0 | 0 | 1 | 1 | 0 | 38 | 38 |
| 1 | 0 | 0 | 1 | 1 | 1 | 39 | 39 |
| 1 | 0 | 1 | 0 | 0 | 0 | 40 | 40 |

(0 = not pressed, 1 = pressed)

Thus, based upon which activation levers 6 are activated, the size of the particular collimator 1 that is inserted into the adaptor 2 can be identified. This information is conveyed from the circuit board 8 to the LINAC connector 9 so that it may be confirmed that the collimator 1 is properly installed and the correct size for the particular patient. Once the collimator 1 is inserted into the adaptor 2, a cap 11 may be placed onto the system to ensure that the collimator 1 does not become displaced.

Similarly, in an alternative embodiment, micro-switches 5 are positioned in the adaptor 2 to be above the collimator 1 when the collimator 1 is inserted into the adaptor 2. The activation levers 6 of the micro-switches are used to detect notches in the top of the collimators 1, where the presence of such notches vary depending on the particular collimator 1.

It is anticipated that there are multiple different sensor mechanisms which can be used to identify the particular small field circular collimator 1. In another embodiment, there is an electrical interface between the adaptor 2 and the collimator 1. Each collimator 1 possesses a unique resistance value which is detected by a resistance measurement circuit on the adaptor 2.

Alternatively, radiofrequency may be used for identification of the individual collimators 1. The collimators 1 would each have a unique radiofrequency associated therewith. The radio frequency of the collimator 1 is detected by a radiofrequency detector in the adaptor 2 or directly in the LINAC.

The collimators 1 may have unique bar codes. The particular bar code of the collimator 2 is detected by a scanner in the adaptor 2.

In yet another embodiment, optical encoding is employed between the adaptor 2 and the collimators 1. This is accomplished through the inclusion of a series light and dark (black and white) bands around the circumference of the collimator 1 at different heights. The placement of the light and dark bands varies depending on the size of the particular collimator 1. The light and dark bands are detected by an optical transmitter and receiver located in the adaptor 2.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

The invention claimed is:

1. A detection system for use in a linear accelerator machine comprising:

a small field circular collimator which possesses an identifying trait that corresponds to a size of the small field circular collimator and with a top end opposite to a bottom end;

an adaptor sized to receive the small field circular collimator;

at least one sensor which detects the identifying trait of the small field circular collimator after insertion of the small field circular collimator into the adaptor and also transmits information concerning the inserted small field circular collimator to the linear accelerator machine, wherein the sensor transmits a signal to a circuit board which is connected to the linear accelerator machine;

further comprising:

the identifying trait that corresponds to the size of the small field circular collimator is at least two grooves in a perimeter of the small field circular collimator;

a hole extending through the adaptor located to correspond to a height of each groove in the collimator after its insertion into the adaptor;

a micro-switch is the sensor, with an activation lever of the micro-switch inserted into each hole of the adaptor, wherein an activation of each micro-switch depends on whether the activation lever of the micro-switch is allowed to extend into a groove in the small field circular collimator corresponding to the hole in which that micro-switch is inserted.

2. The detection system according to claim 1 wherein each micro-switch sends a binary number to the circuit board and a decimal number corresponding to a particular small field circular collimator is generated as a result of the binary numbers generated by every micro-switch.

3. The detection system according to claim 1 wherein the decimal number generated corresponds to a mm size of the small field circular collimator.

4. The detection system according to claim 1 wherein the identifying trait of the small field circular collimator is a range of one to six grooves made in the perimeter thereof and the adaptor has six holes made therein which correspond to the heights of the grooves in the perimeter of the collimator.

5. The detection system according to claim 4 wherein each micro-switch sends a binary number to the circuit board and a decimal number corresponding to a particular small field circular collimator is generated as a result of the binary numbers generated by every micro-switch, and the decimal number generated corresponds to the mm size of the small field circular collimator.

6. The detection system according to claim 1 wherein the identifying trait of the small field circular collimator is a resistance value and the sensor is a resistance measurement circuit located on the adaptor.

7. The detection system according to claim 1 wherein the identifying trait of the small field circular collimator is a particular radiofrequency; the sensor comprises a radio signal transmitter on the small field circular collimator and a radio signal receiver located on the adaptor.

8. The detection system according to claim 1 wherein the identifying trait of the small field circular collimator is a radiofrequency; the sensor comprises a radio signal transmitter on the small field circular collimator and a radio signal receiver located on the linear accelerator machine.

9. The detection system according to claim 8 wherein the sensor transmits a signal to a circuit board which is connected to the linear accelerator machine.

10. The detection system according to claim 8 wherein the sensor transmits a signal to the linear accelerator machine.

11. The detection system according to claim 1 wherein the identifying trait of the small field circular collimator is a bar code and the sensor is a bar code scanner located on the adaptor; wherein information from the bar code scanner is transmitted to the circuit board which transmits the information to a connector of the linear accelerator machine.

12. A detection system for use in a linear accelerator machine comprising:

a small field circular collimator which possesses an identifying trait that corresponds to the size of the small field circular collimator and with a top end opposite to a bottom end;

an adaptor sized to receive the small field circular collimator;

at least one sensor which detects the identifying trait of the small field circular collimator after insertion of the small field circular collimator into the adaptor and also transmits information concerning the inserted small field circular collimator to the linear accelerator machine;

the identifying trait that corresponds to the size of the small field circular collimator is at least two notches made in the top end of small field circular collimator which is inserted into the adaptor;

a hole extending through the adaptor located to correspond to a location of each notch in the collimator after its insertion into the adaptor; and a micro-switch as the sensor with an activation lever of the micro-switch inserted into each hole of the adaptor, wherein the activation of each micro-switch depends on whether the activation lever of the micro-switch is allowed to extend into a notch in the small field circular collimator corresponding to the hole in which that micro-switch is inserted.

13. The detection system according to claim 12 wherein the sensor transmits a signal to a circuit board which is connected to the linear accelerator machine.

14. A detection system for use in a linear accelerator machine comprising:

a small field circular collimator which possesses an identifying trait that corresponds to the size of the small field circular collimator and with a top end opposite to a bottom end;

an adaptor sized to receive the small field circular collimator;

at least one sensor which detects the identifying trait of the small field circular collimator after insertion of the small field circular collimator into the adaptor and also transmits information concerning the inserted small field circular collimator to the linear accelerator machine, wherein the identifying trait of the small field circular collimator comprises placement of light and dark bands along a perimeter of the collimator at varying heights; the sensor is a combined light emitting and detecting assembly located on the adaptor with the sensor connected to a circuit board which is connected to the linear accelerator machine.

15. A detection system for use in a linear accelerator machine comprising:

a small field circular collimator which possesses an identifying trait that corresponds to a size of the small field circular collimator and with a top end opposite to a bottom end;

an adaptor sized to receive the small field circular collimator;

at least one sensor which detects the identifying trait of the small field circular collimator after insertion of the small field circular collimator into the adaptor and also transmits information concerning the inserted small field circular collimator to the linear accelerator machine;

the identifying trait that corresponds to the size of the small field circular collimator is at least two grooves in a perimeter of the small field circular collimator;

a hole extending through the adaptor located to correspond to a height of each groove in the collimator after its insertion into the adaptor; and the sensor inserted into each hole of the adaptor, wherein an activation of each sensor depends on whether the sensor is allowed to extend into a groove in the small field circular collimator corresponding to the hole in which that sensor is inserted.

16. The detection system according to claim 15 wherein each sensor sends a binary number to the circuit board and a decimal number corresponding to a particular small field circular collimator is generated as a result of the binary numbers generated by each sensor.

17. The detection system according to claim 15 wherein the identifying trait of the small field circular collimator is a resistance value and the sensor is a resistance measurement circuit located on the adaptor.

18. The detection system according to claim 15 wherein the identifying trait of the small field circular collimator comprises placement of light and dark bands along a perimeter of the collimator at varying heights; the sensor is a combined light emitting and detecting assembly located on the adaptor with the sensor connected to a circuit board which is connected to the linear accelerator machine.

* * * * *